US005169150A

United States Patent [19]

Tindale

[11] Patent Number: 5,169,150

[45] Date of Patent: Dec. 8, 1992

[54] PUTTING STROKE CORRECTING DEVICE

[76] Inventor: John C. Tindale, 347 Bonnie Brae Ave., Rochester, N.Y. 14618

[21] Appl. No.: 772,160

[22] Filed: Oct. 7, 1991

[51] Int. Cl.[5] ..... A63B 69/36

[52] U.S. Cl. ..... 273/187.4; 273/194 A; 273/186.3

[58] Field of Search ..... 273/164, 186 A, 183 D, 273/194 A, 163 R, 183 E, 186 D, 32 H, 193 R

[56] References Cited

U.S. PATENT DOCUMENTS 3,826,495 7/1974 Elkins ..... 273/164 X
4,174,839 11/1979 Marrs ..... 273/164 X
5,029,868 7/1991 Cloud ..... 273/186 A X

*Primary Examiner*—George J. Marlo

*Attorney, Agent, or Firm*—Shlesinger Fitzsimmons & Shlesinger

[57] ABSTRACT

A laser is mounted in the head of a putter so that its beam can be directed through an opening in the plane, ball engaging surface of the putter along a path which extends normal to the putter face, and parallel to a first sighting line positioned on the upper surface of the putter head. While for test purposes a golfer aims the sighting line toward the center of a simulated putting hole target, which is spaced from the head, the laser is energized to direct its beam toward the target. The extent of the misalignment of the putter face with the simulated hole will be indicated by the extent to which the light beam is angularly offset from the center of the target. The first sighting line is then replaced by a second sighting line reflecting this angular offset.

9 Claims, 3 Drawing Sheets

PUTTING STROKE CORRECTING DEVICE

BACKGROUND OF THE INVENTION

This invention relates to the game of golf, and more particularly to an improved device for correcting the putting stroke of a golfer by compensating for the inherent misalignment of his or her putting stroke.

Thorough testing of the putting strokes of thousands of golfers has shown that nearly all golfers have misaligned putting strokes. Such testing may be conducted by utilizing a device of the type disclosed in my U.S. Pat. No. 4,809,984. Striving to improve their putting game, many golfers have relied upon stroke correcting devices to provide calibrated sight indices which are designed to compensate for putting stroke misalignments. One such device, as disclosed in U.S. Pat. No. 4,174,839, comprises a plurality of angularly spaced lines which are placed on the upper surface of the club head to aid with the alignment of putts on sloped greens. That device, however, does not attempt to correct any inherent misalignment of a golfer's putting stroke.

More pertinent to this invention are U.S. Pat. Nos. 3,680,860 and 3,826,495, which are directed to a method of correcting a putting stroke by determining the normal angular error introduced into one's stroke. In one embodiment this prior art device relies upon a light source eminating from the target and reflecting off of a displaced mirror to a measuring scale. The problem with this device is that it does not equate to an actual putting stroke, because the golfer being tested does not hold a club (putter) at any time during the test. Moreover, the test does not provide for a direct measurement of the degree of misalignment, but rather a mere approximation of that degree. Although a golf club is employed when testing with the device disclosed in my above-noted U.S. Pat. No. 4,809,984, it is anchored to a horizontal surface so that it may always be realigned to the target. This prevents the device from being portable, and therefore it is not very accessible Accordingly, it is therefore a primary object of this invention to provide a correcting device comprising a putter and associated light source which can be utilized directly to measure a golfer's tendency to misalign the putter face when lining up a putt.

It is also an object of this invention to provide an improved putting stroke correcting device which is portable, and therefore is capable of determining putting stroke misalignment in a variety of locations, both outdoors and indoors.

Another object of this invention is to provide a simple device of the type described which can be utilized quickly and accurately to determine and correct any putting stroke error attributable to misalignment of the putter head.

Other objects of this invention will become apparent hereinafter from the specification and from the recital of the appended claims, particularly when read in conjunction with the accompanying drawings.

SUMMARY OF THE INVENTION

This improved putting stroke correcting device comprises a special putter having thereon a novel putter head, which has therethrough a bore that extends perpendicular to and through the center of the putter face. A battery-operated and switch controlled laser is secured coaxially in the bore in the putter head so that its beam will be perpendicular to the putter face, and therefore will provide a means to determine alignment of the putter face. A calibrated measuring device is placed over a target which is located a known distance from the site where a golfer stands during a test. When a removable sighting line on the putter head is aimed by a golfer towards the target, the laserbeam will indicate any misalignment of the putter face by illuminating a point on the calibrated measuring scale.

Initially, a golfer would begin with a sighting line which is positioned normal to the putter face, and which represents zero degree misalignment. The sighting line may be removably attached to the putter in the form of a plastic chip, each chip having thereon a sighting line inscribed on its upper surface, and the angular correction, if any, written in 0.5° intervals on the lower surface of the chip. The chip is adhered by pressure sensitive adhesive to the putter head or to the laser extending therethrough. Once the misalignment has been determined, a corrective sighting line may be attached to the putter head so that the golfer can confirm the correction which is needed. Subsequently, the golfer may then have the corrective sighting line inscribed on his or her putter head.

Since this device is so simple and easily transported, it may be utilized indoors on a flat surface with the target and calibrated measuring scale set up against a wall or door, or may be used outdoors on a practice putting green with the calibrated measuring apparatus centered over the hole.

DETAILED DESCRIPTION OF THE PREFERRED EMBODIMENTS

Figure 1:
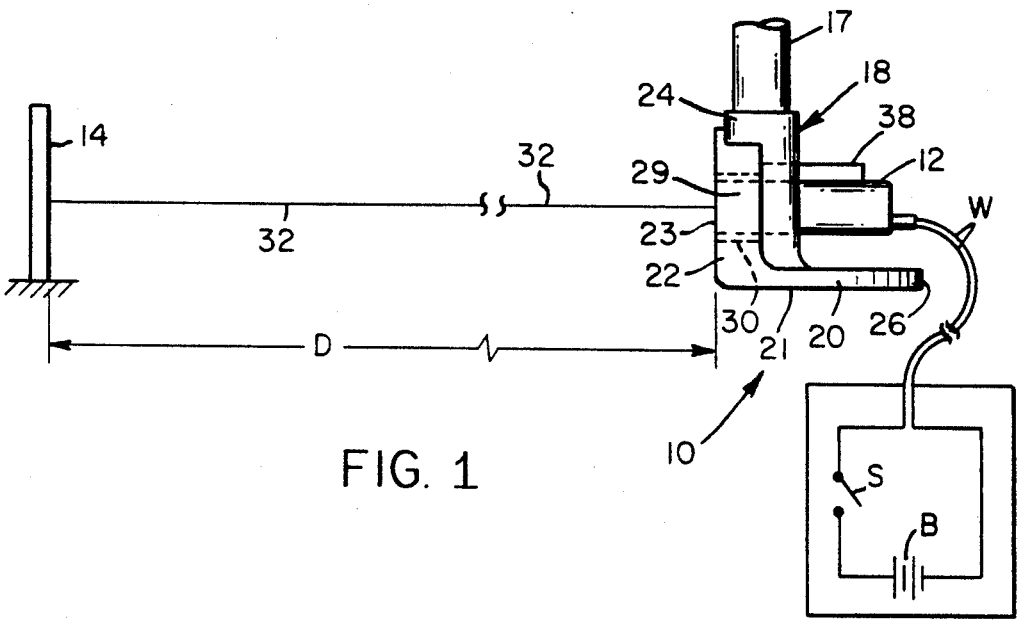
FIG. 1 is a fragmentary side elevational view of a special putter and associated light source therefor which form part of a correcting device made according to one embodiment of this invention, and illustrating diagramatically the relationship between the putter and an associated target and measuring scale.
Figure 2:
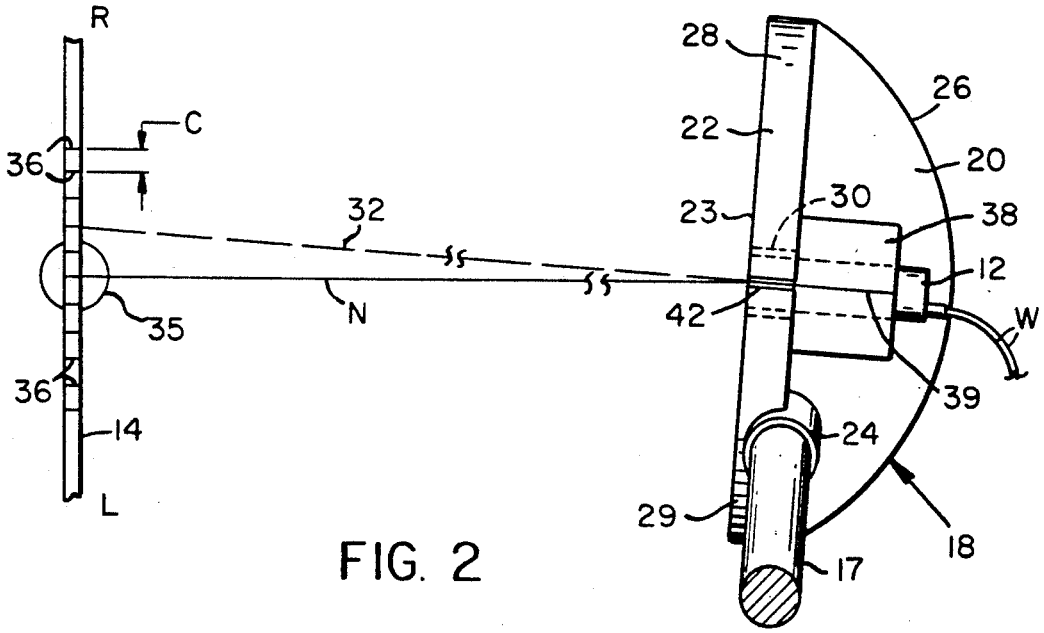
FIG. 2 is a fragmentary plan view of this special putter and light source, and illustrating the method of measuring misalignment of the putter face in relation to the associated target.

Referring now to the drawings by numerals of reference, 10 denotes generally a putter face aligning or putting stroke correcting device comprising a laser 12, a calibrated measuring scale 14, and a special putter having a shaft 17 and a novel putter head 18. Putter head 18 comprises a generally flat, weighted base section 20 having a plane bottom surface 21, and an integral, upstanding laser-supporting section 22, which has a plane, flat outer face 23 that projects at right angles upwardly from the forward or left hand edge of the surface 21 as shown in FIGS. 1 and 2. A conventional sighting line or notch 42 is formed centrally on the upper surface of section 22 to extend at right angles to surface 23. The lower end of shaft 17 is secured in an annular socket or receptacle 24, which is integral with and projects upwardly from the upper surface of base 20 at a slight angle to the vertical.

As thus far described the putter head 18 is conventional, and for this purpose the rear or right hand edge 26 of its base 20 is shaped in the form of an arc or curve; the rear face of upstanding section 22 is parallel to the front face 23 thereof; and opposite ends of the upper edge of section 22 are beveled as at 28 and 29.

In accordance with the teachings of this invention, the upstanding section 22 of head 18 has extending transversely through the center thereof a circular bore 30 the axis of which extends normal to surface 23. Laser 12 is coaxially seated at one end thereof within bore 30 so that its lens 31 (FIG. 3) does not project from bore 30 beyond the plane containing the putter face 23. Laser 12 is connected at its opposite end by a pair of wires W and a conventional, manually operated on/off switch S to a DC power supply in the form of a battery B, or the like. Switch S thus controls the emittance of a laserbeam 32 from laser 12.

Positioned a predetermined distance D (e.g. ten feet) from the putter head 18 is target 35 (FIG. 2), which may be a hole on a putting green or a circular disc representing the same. Centered above target 35 and perpendicular to the plane of target 35 is the calibrated measuring scale 14, which in the embodiment illustrated is a long, flat, rigid sheet that may be made of cardboard, plastic, aluminum or the like, and which has inscribed on the face thereof a plurality of gradient lines 36. The distance C between any two adjacent gradient lines 36 represents a 0.5° angular displacement of the putter face 23 with respect to an imaginary line N (FIG. 2) extending at right angles to scale 14 through the center of target 35.

Figure 5:
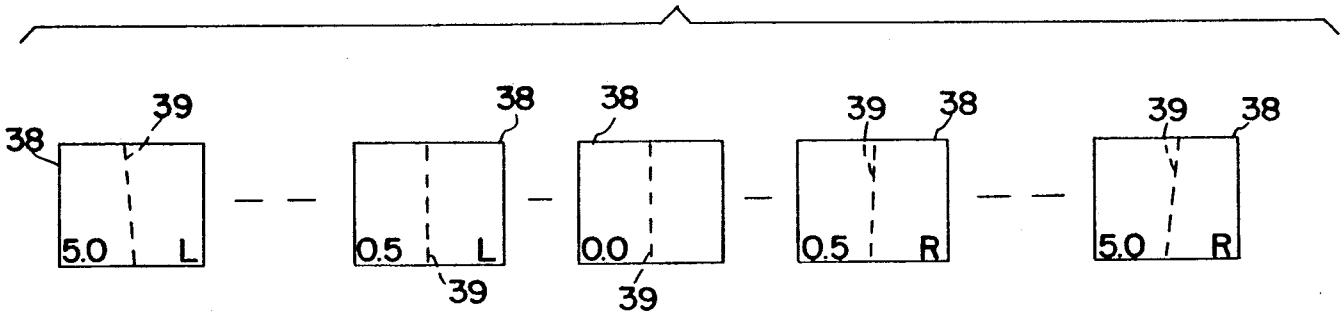
FIG. 5 illustrates a set (five in the embodiment illustrated) of sighting line members or chips, one of which is adapted to be fastened to the face of a putter as noted hereinafter.

Removably attached to laser 12 rearwardly of the putter head section 22 is a rectangular, plastic chip 38. The plane, forward edge of chip 38 is positioned flush against the back of putter section 22 so that the chip is maintained parallel to weighted base 21. Chip 38 has on its upper surface a sighting line 39, and on its lower surface a layer of pressure sensitive adhesive for securing the chip on laser 12. As noted hereinafter, way of example in FIG. 5, chip 38 is but one of many such chips which can be employed for testing and correcting a golfer's stroke, and which differ from each other only as to the angular displacement of the sighting line 39 of a chip from a line normal to its forward edge (i.e. from the conventional sighting line or notch 42), and with respect to indicia on the chip identifying such angular displacement. In the sample chips 38 illustrated in FIG. 5, the angular displacement of the sighting line 39 of each such chip as denoted by the numerals illustrated in the lower left hand corner of each, illustrated chip 38; and the direction of offset (to the right or left of the sighting line) is denote by the letter L or R noted in the lower right hand corner of the illustrate chips.

For example, chip 38 as shown in FIG. 2 is used at the outset of a test, and has thereon a sighting line 39 which extends at right angles to the forward edge of chip 38, and lies in a plane containing the axis of laser 12. The rear face of section 22, which is engaged by the forward edge of chip 38, is parallel to the putter face 23, so that the sight line 39 of this particular chip 38 also extends normal to face 23 and is aligned with the conventional sight line 42. Therefore, when the putter face is positioned parallel scale 14 (not so in FIG. 2), and line 39 is coplanar with line 42 and imaginary line N, the putter face will be properly aligned with target 35, and sight line 39 will be regarded as having a zero degree (0°) angular or sighting line displacement. As noted hereinafter, the inherent misalignment of the putter face 23 differs from golfer to golfer, and consequent angular displacement of sighting line 39 will vary accordingly. The net angular displacement of the sighting line 39 represented by a respective chip 38 may be marked to the nearest 0.5° on the lower surface of the chip, as well as the direction of misalignment, e.g. toward the right or left (R or L) end of scale 14 (i.e., clockwise or counterclockwise in FIG. 2).

In use, a test is commenced by attaching to the laser 12 a chip 38 having thereon a zero degree sighting line 39 as shown in FIG. 2. While gripping the shaft 17 in a usual putting grip, a golfer must then assume his or her putting stance with the putter head 18 placed at a point a distance D from target 35, and must align the putter face 23 towards target 35 with the aid of the 0° displaced sighting line 39. When satisfied with the alignment, the golfer will so indicate to a nearby operator who will close the switch S to cause laser 12 to emit laserbeam 32. Laserbeam 32 will strike the calibrated measuring scale 14 at precisely the point where putter face 23 was aimed, and the angular displacement (between N and beam 32) as indicated by scale 14 is recorded. This process is then repeated several times, depending on the consistency of the misalignment, until an average angular displacement is determined.

Once the golfer's angular displacement has been calculated, for example the angular displacement of 1.0° R as shown in FIG. 2, the putter is refitted with a new chip 38 having a corrected sighting line (not illustrated), which will be inclined 1° R, from the position of line 39 as shown on the chip 38 illustrated in FIG. 2. When the corrected sighting line of this new chip 38 is used by the golfer as his or her proper sighting line, it will compensate for the golfer's 1.0° misalignment to the right. The golfer may again assume his or her putting stance with the putter head 18 located at the point positioned a distance D from the target 35, and when satisfied with the alignment of putter face 23 with target 35, may again signal the operator to close the switch S to emit laserbeam 32. The laserbeam 32 should now be striking the center of calibrated measuring scale 14 directly above target 35, indicating a 0° angular displacement. In the instance where laserbeam 32 does not strike the center of the calibrated measuring apparatus 14, then the above process should be repeated in order to determine whether the corrected sighting line has overcompensated or undercompensated for the putter alignment. If the corrected sighting line on a chip 38 is not properly fitted for the golfer, then a new series of trials may be performed using a more or less angularly displaced sighting line.

Figure 3:
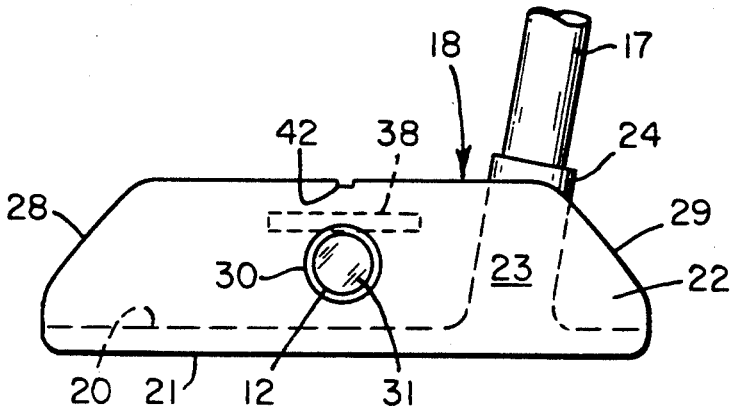
FIG. 3 is a fragmentary front elevational view of this special putter and light source.
Figure 4:
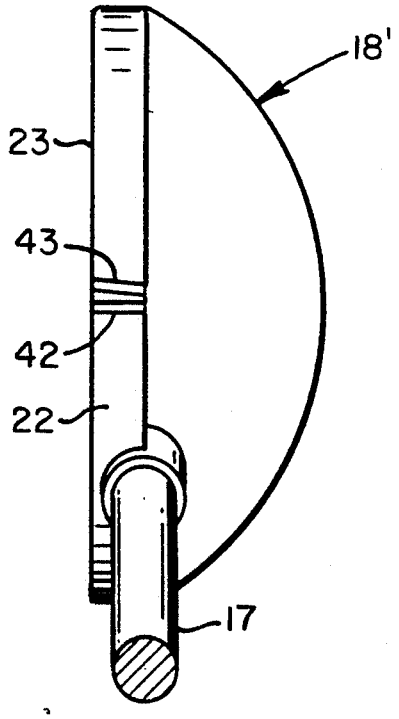
FIG. 4 is a fragmentary plan view of a conventional putter having inscribed thereon a normal sighting line as well as a corrective sighting line as determined by the correcting device shown in FIGS. 1-3.

Referring now to FIG. 4, wherein like numerals are employed to denote elements similar to those shown in FIGS. 1-3, numeral 18' denotes generally a conventional putter head bearing a corrective sight line determined in accordance with this invention. Normally a 0° displaced sighting notch or line 42 is formed on the upper edge of section 22 of putter head 18'. However, in order to provide for corrected alignment of the putter face 23 in relation to a target, a corrective sighting line or notch 43 must also be formed on the putter head, and must be inclined in relation to the normal sighting line 42 to the extent determined by a test of the type described above. The corrective sighting line 43 thereafter should be used by the golfer for alignment of the putter face with a putting green hole in order to compensate for any misalignment that he or she normally would tend to introduce into his or her putting stroke.

From the foregoing it will be apparent that the present invention provides relatively simple and portable means for detecting the amount of misalignment of the putting face which a golfer might tend to introduce to his or her putting stroke each time a golf ball is so addressed. By determining this natural tendency to misalign the face of the putter, and then marking a new line on the head of the putter to denote the sighting line which should be employed by that particular golfer, it is possible substantially to reduce errors in one's putting stroke.

While this invention has been illustrated and described in connection with certain plastic chips 38 having sighting lines thereon for the purpose of aiding a golfer in aligning the putter face 23 in relation to the target 35, it will be apparent to one skilled in the art that other means may be used to attach a sighting line 39 to the putter head 18. Moreover, obvious variations of on/off switch apparatus may be employed in lieu of switch S for causing the laser 12 to emit its laserbeam 32, as long as such apparatus is accompanied with a power supply capable of operating the laser 12.

Furthermore, while this invention has been illustrated and described in detail in connection with only certain embodiments thereof, it will be apparent that it is capable of still further modification, and that this application is intended to cover any such modifications as may fall within the scope of one skilled in the art or the appended claims.

I claim:

1. A device for detecting and correcting alignment errors in a golfer's putting stroke, comprising a target having thereon a plurality of spaced graduations (36) one of which is representative of the center of an imaginary putting green hole, a club, including a shaft and a putter head secured to one end of said shaft, a plane face formed on one surface of said putter head to simulate the golf ball engaging surface of a conventional putter, means removably mounting a first sighting line (39) on another surface of said putter head to extend normal to said face of the putter head, and to be observable by a golfer holding said shaft of the club, and to be aimed by such golfer toward said one graduation on said target to emulate proper alignment of said face of the putter head with said imaginary putting green hole, and means on said putter head operable, while said first sighting line (39) is aimed by said golfer toward said one graduation on said target, to direct a collimated beam of light onto said target along a path (32) parallel to said first sighting line (39), whereby the point where said beam of light strikes said target will indicate the angular extent to which the golfer has actually misaligned said face of the putter head relative to the center of said imaginary putting green hole.

2. A device as defined in claim 1, wherein said means comprises, a light source mounted on said head in registry with an opening in said face of said putter head, and means operable selectively to energize said light source and to direct said beam of light therefrom through said opening and toward said target.

3. A device as defined in claim 2, wherein said light source comprises a laser.

4. A device as defined in claim 1, including means for replacing said first sighting line (39) with a second sighting line which is angularly inclined to a line normal to said face, at least to the angular extent of the misalignment indicated by said target.

5. A device as defined in claim 4, including a third sighting line (42) fixed to said putter head to intersect said face at right angles thereto, and disposed to register with said first sighting line when the latter is mounted on said other surface of said putter head.

6. A device for detecting alignment errors in a golfer's putting stroke, comprising a target representive of a putting green hole and having thereon equispaced graduations, including a distinguishable central graduation representing the center of said target, a putter including a shaft and a putter head, said putter head having thereon a putter face defining a plane, and having therethrough a cylindrical bore opening at one end on the center of said putter face, whereby said bore has an axis perpendicular to said putter face, a light source mounted coaxially in said bore, a set of sighting line members, each of said members having a plane side edge disposed to be placed parallel to said putter face, and having on an upper surface thereof a single sighting line inclined at a predetermined angle to said side edge, means on each of said sighting line members for identifying said angle of inclination of its respective sighting line, and means for releasably attaching each of said sighting line members one at a time to said putter head with said sighting line thereon disposed to be observed and aimed toward said central graduation by a golfer holding said club shaft.

7. A device as defined in claim 6, wherein said light source is a laser operable to illuminate a point on or near one of said graduations on said target, said one graduation indicating a measurable alignment error and angular displacement of said putter face in relation to said center of said target, when said sighting line is aimed by a golfer toward said central graduation.

8. A device as defined in claim 6, wherein said means for identifying said angle of inclination of a respective sighting line comprises a code printed on each of said members, said code having a numerical portion indicating the magnitude of said angle of inclination, and a latter portion indicating the direction of angular inclination from said side edge of the associated member.

9. A device as defined in claim 6, wherein said means for releasably attaching each of said sighting line members to said putter head comprises a contact adhesive on the lower side of each of said members.

* * * * *